US005299661A

United States Patent [19]

Pramanik et al.

[11] Patent Number: 5,299,661

[45] Date of Patent: Apr. 5, 1994

[54] MECHANICAL OVERSPEED SAFETY DEVICE

[75] Inventors: Mukunda B. Pramanik, Burlington, Conn.; Rajendra V. Mistry, Cincinnati, Ohio; Sib S. Ray, Newington, Conn.

[73] Assignee: Otis Elevator Company, Farmington, Conn.

[21] Appl. No.: 971,005

[22] Filed: Nov. 3, 1992

[51] Int. Cl.[5] ..... B66B 5/16

[52] U.S. Cl. ..... 187/89; 188/189

[58] Field of Search ..... 187/38, 89, 90, 88; 188/188, 189

[56] References Cited

U.S. PATENT DOCUMENTS

| | | | |
|---|---|---|---|
| 1,864,588 | 6/1932 | Dunlop | 187/89 |
| 3,327,811 | 6/1987 | Mastroberte | 187/38 |
| 3,441,107 | 4/1969 | Thorne et al. | 187/90 |
| 4,923,055 | 5/1990 | Holland | 187/89 |

*Primary Examiner*—D. Glenn Dayoan
*Assistant Examiner*—Kenneth Noland

[57] ABSTRACT

A bidirectional overspeed device is provided for an elevator system having an elevator car for travel within a hoistway along a guiderail. The elevator includes a governor rope running from a governor sheave at the top of the hoistway to a tension sheave at the bottom of the hoistway, and a bidirectional overspeed device. The bidirectional overspeed device comprises a bidirectional governor, a first safety brake, a second safety brake and a bidirectional linkage apparatus. In the event of an overspeed condition in either direction, the bidirectional governor clutches the governor rope, thereby operating the bidirectional linkage apparatus which connects the governor rope to the safety. Depending on the direction of the car travel, the linkage apparatus is either pulled upward or downward. Consequently, either the first or second safety is engaged and the elevator car is stopped.

8 Claims, 5 Drawing Sheets

MECHANICAL OVERSPEED SAFETY DEVICE

TECHNICAL FIELD

This invention relates to rope supported elevators and more specifically to overspeed governors therefore.

BACKGROUND ART

An elevator comprises an elevator car and a counterweight attached to each other by a series of ropes. The ropes extend up the hoistway from the elevator car to the machine room of the elevator. In the machine room, the ropes wrap around a sheave attached to an elevator drive and return down the hoistway, to the counterweight.

For safety reasons, elevators are generally required to have an overspeed governor and safeties. A typical overspeed governor often includes a governor rope extending the length of the hoistway, attached to a governor sheave and tensioner. The governor rope is fixed to the elevator car by a linkage extending from the rope to a pair of safeties attached to the car. Because of the fixed relationship, any distance traveled by the car causes the rope to travel a like amount.

In this type of arrangement, if the downward velocity of the elevator exceeds a predetermined limit, i.e., an overspeed condition, a centrifugal flyweight assembly driven by the governor sheave swings outwardly, tripping a switch thereby removing power to the elevator drive and brake. If the downward elevator speed continues to increase, the flyweight assembly swings outwardly still further and operates a governor brake. The governor brake applies a frictional drag force to the governor rope, thereby actuating the safeties attached to the elevator car. The safeties act on a pair of guiderails and the car is consequently brought to a stop safely. U.S. Pat. No. 3,327,811 to Mastroberte discloses such an arrangement.

This style overspeed governor, although effective, protects against overspeed conditions only when the elevator car is descending. In the event of a brake failure or a drive gear failure in a geared machine, for example, a heavier counterweight will cause a lighter elevator car to accelerate upwardly. The unidirectional limitation of this style governor renders it powerless to stop an upwardly accelerating car. In recent years, elevator codes have changed and now require an overspeed device capable of stopping the elevator in both the upward and downward direction. Therefore, what is needed is an overspeed device capable of stopping the elevator in both the upward and downward direction.

DISCLOSURE OF THE INVENTION

It is therefore an object of the present invention to provide a mechanical overspeed device capable of stopping an elevator in either the ascending or descending direction of travel.

According to the present invention, a bidirectional overspeed device is provided for an elevator system having an elevator car for travel within a hoistway along a guiderail. The elevator includes a governor rope running from a governor sheave at the top of the hoistway to a tension sheave at the bottom of the hoistway. The bidirectional overspeed device comprises a bidirectional governor, an upper safety brake, a lower safety brake and a bidirectional linkage means. In the event of an overspeed condition in either direction, the bidirectional governor grips the governor rope, thereby operating the bidirectional linkage means which connects the governor rope to a safety. Depending on the direction of car travel, either the upper or lower safety is engaged and the elevator car is stopped.

An advantage of the present invention is that it provides a mechanical overspeed device capable of operating in either the ascending or descending direction of travel.

A further advantage of the present invention is that it eliminates the need for a second governor arrangement fixed to the counterweight, as a means to stop the elevator car in either direction of travel.

These and other objects, features and advantages of the present invention will become more apparent in light of the detailed description of the best mode embodiment thereof, as illustrated in the accompanying drawings.

BEST MODE FOR CARRYING OUT THE INVENTION

Figure 1:
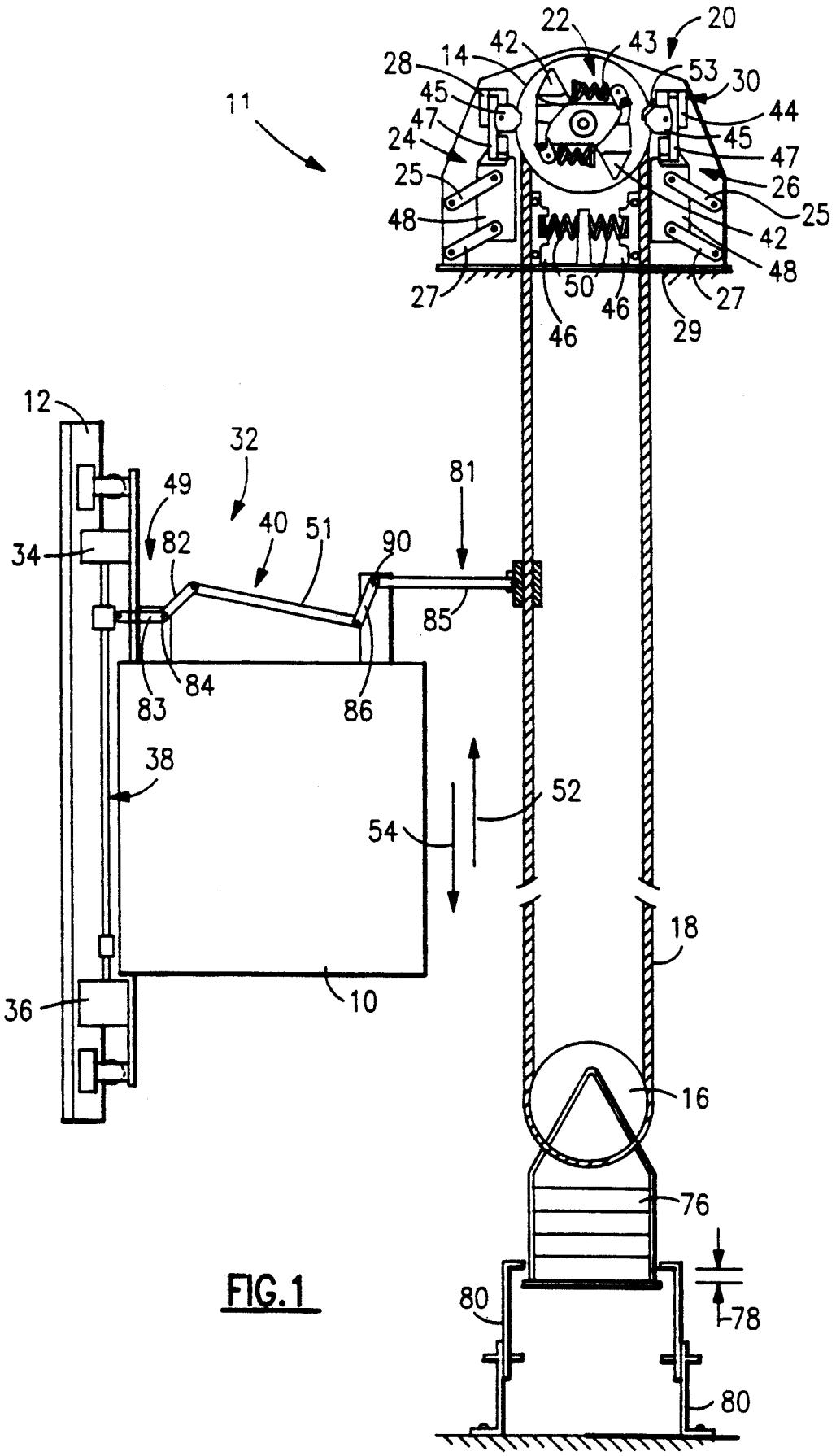
FIG. 1 is a diagrammatic view of the overspeed governor and the elevator car.

Referring to FIG. 1, an elevator comprises an elevator car 10, a guiderail 12, a governor sheave 14, a tension sheave 16, a governor rope 18, and a bidirectional overspeed device 11 arranged within a hoistway (not shown). It is known in the art that there is a fixed relationship between the elevator car 10 and the governor sheave 14 such that the linear motion of the car 10 is translated into rotational motion of the governor sheave 14. Generally speaking, the fixed relationship is created by fixedly attaching the elevator car 10 to the governor rope 18 as is known in the art.

Figure 1A:
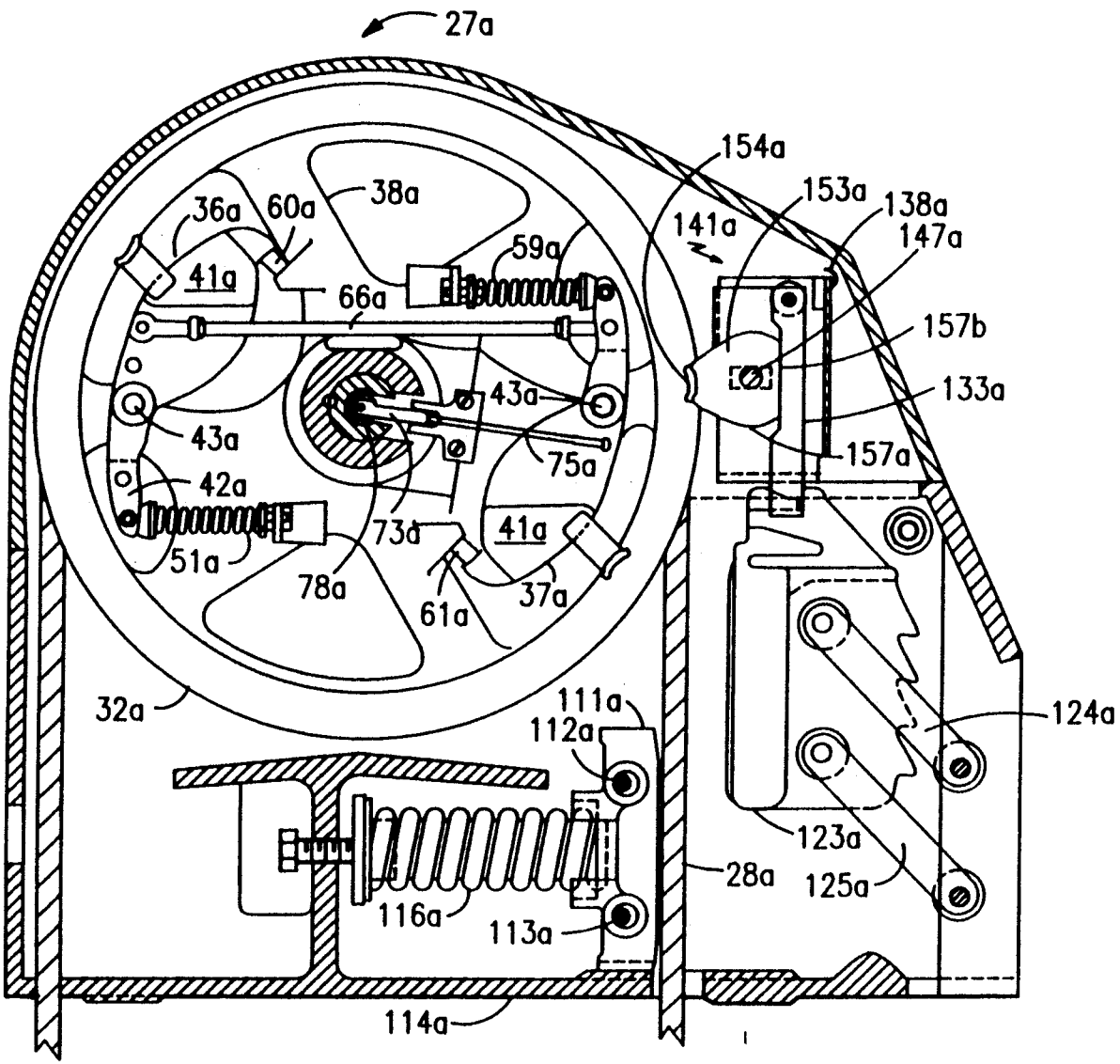
FIG.1A Prior Art
FIG. 1A is a prior art illustration taken from U.S. Pat. No. 3,327,811.

Referring to FIG. 1A, U.S. Pat. No. 3,327,811 to Mastroberte discloses a governor **27*a* having identical weights 36*a*, 37*a* rotatably mounted on pins 43*a* which are fixed to the web 38*a* of the sheave 32*a*. Each pin 43*a* is received by a weight 36*a*, 37*a* in between a massive portion 41*a* and an extending arm portion 42*a* of the weight 36*a*, 37*a*. Consequently, each portion 41*a*, 42*a* may rotate about the pin 43*a*. Springs 51*a*, 59*a* urge the massive portions 41*a* of the weights 36*a*, 37*a* to rotate radially inward about the pin 43*a*, resting against bumpers 60*a*, 61*a*. Rotation of the sheave 32*a* in either direction causes the massive portions 41*a* to be urged by centrifugal forces to fly radially outward, against the urging of the springs 51*a*, 59*a*. A tie rod 66*a* interconnects the weights 36*a*, 37*a*** forcing them to act in unison.

Mastroberte describes further that a plunger **78*a* attached to a bell crank lever 73*a* is used to operate a bank of switches (not shown) in case of an overspeed condition. Specifically, the bell crank lever 73*a* is attached to one of the weights 37a by a link 75a. When the massive portion 41a of the weight 37a flies radially outward, the link 75a pivots the bell crank lever 73a, which in turn moves the plunger 78a axially. The axial movement of the plunger displaces a number of electrical contacts (not shown). The plunger 78a may be connected to the motor control circuit of the elevator in any manner known in the art, so as to exercise a corrective action on the speed control circuits of the motor (not shown), thereby tending to reduce its speed. If this corrective action is sufficient, the speed of the motor, car, and sheave 32a will decrease, the weights 36a, 37a will move radially inward, and the plunger 78a** will return to its former position without any manual resetting.

If however, the rotational speed of the sheave 32a increases further, the weights 36a, 37a swing radially outward still further and strike a lug 153a, 154a attached to a tripping mechanism 141a. The lugs 153a, 154a are rotatably mounted on a bolt 147a. The lugs 153a, 154a have a cam portion 157a and a flat surface 157b. In the normal position, the flat surface 157b rests against a pivotly mounted latch 133a which is biased against the lugs 153a, 154a by a spring 138a. Rotation of the lugs 153a, 154a forces the cam portion 157a of the lugs into the latch 133a, thereby pivoting the latch 133a.

In the normal position, the latch 133a holds a swinging rope gripping jaw 123a out of contact with the governor rope 28a. A stationary rope gripping jaw 111a is positioned on the side of the rope 28a opposite from the swinging jaw 123a. The stationary jaw is attached to a frame 114a by a pair of pins 112a, 113a which extend through oversized holes in the jaw 111a. The jaw 111a is urged toward the rope 28a by a compression spring 116a.

When the latch 133a pivots in an overspeed condition, the swinging jaw 123a is allowed to fall into contact with the rope 28a. If the section of rope 28a contacting the swinging jaw 123a is moving downwardly, friction between the rope 28a and the jaw 123a assists gravity in the downward movement of the jaw 123a. The swinging jaw 123a comes to rest with links 124a, 125a substantially horizontal, thereby clamping the rope 28a between the jaws 111a, 123a with a force dependent upon the force of the spring 116a. (see Mastroberte Col. 5, lines 26–33)

Referring to FIG. 1, in the present invention a bidirectional governor 20 is attached to the governor sheave 14. The bidirectional governor 20 includes a centrifugal actuator 22, a first clutch means 24, a second clutch means 26, a first tripper 28 and a second tripper 30. The governor rope 18 passes over the governor sheave 14 attached to the bidirectional governor 20 at the top of the hoistway and extends down to the tension sheave 16 at the bottom of the hoistway. The sheave 14 and the centrifugal actuator 22 rotate about the same rotational axis. The centrifugal actuator 22 comprises a pair of identical weights 42 pivotly mounted to the sheave 14. Each weight 42 is biased toward the rotational center of the sheave 14 by a spring 43.

Each tripper 30,28 includes a pivotly mounted lug 45 aligned in the same plane as the weights 42 of the centrifugal actuator 22. Both trippers 28,30 also have a pivotly mounted latch 47 which is biased against the adjacent clutch means 24,26.

Each clutch means comprises a stationary jaw 46 positioned on one side of the governor rope 18 and a swinging jaw 48 positioned on the opposite side. In the normal position, neither jaw is in contact with the governor rope running therebetween. Each swinging jaw 48 is held out of contact with the governor rope 18 by the latch 47 of the associated tripper 28,30. A pair of pins 29 limits the travel of the stationary jaws 46 and consequently prevents the jaw from contacting the rope 18. A spring 50 biases each stationary jaw 46 in the direction of the rope 18.

A bidirectional linkage means 32 attaches the governor rope 18 to an upper safety 34 and a lower safety 36. Specifically, the bidirectional linkage means includes a bidirectional first linkage 38 connecting the upper 34 and lower 36 safeties and a second linkage 40 connecting the first linkage 38 to the governor rope 18.

Figure 2:
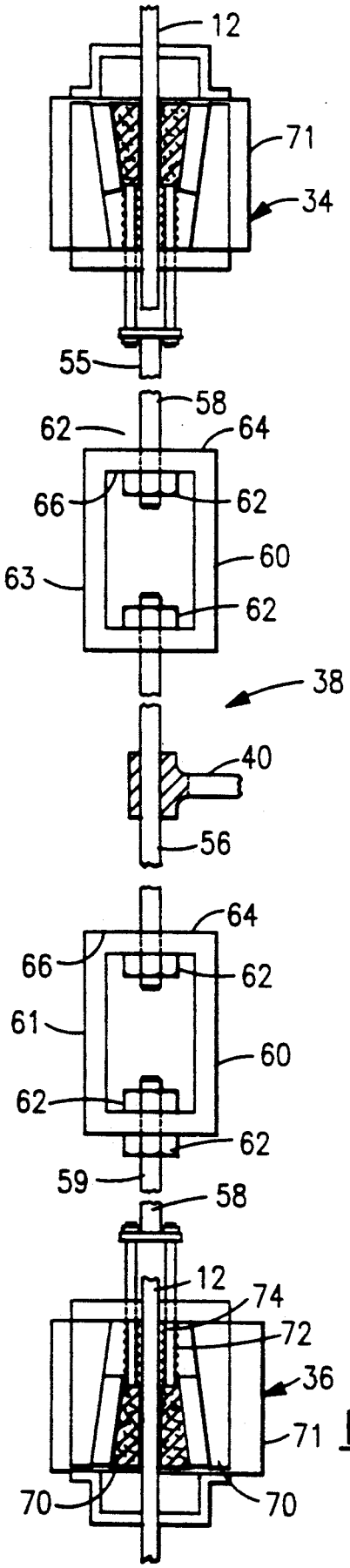
FIG. 2 is a diagrammatic view of a first embodiment of the bidirectional first linkage means shown in FIG. 1.

Referring to FIG. 2, one embodiment of the first linkage 38 comprises a center rod 56, an upper 63 and lower 61 link, and an upper 55 and lower 59 end rod. The upper and lower end rods 55,59 are attached to the upper and lower safeties 34,36, respectively. The center rod 56 is fixedly attached to the second linkage 40.

Figure 3:
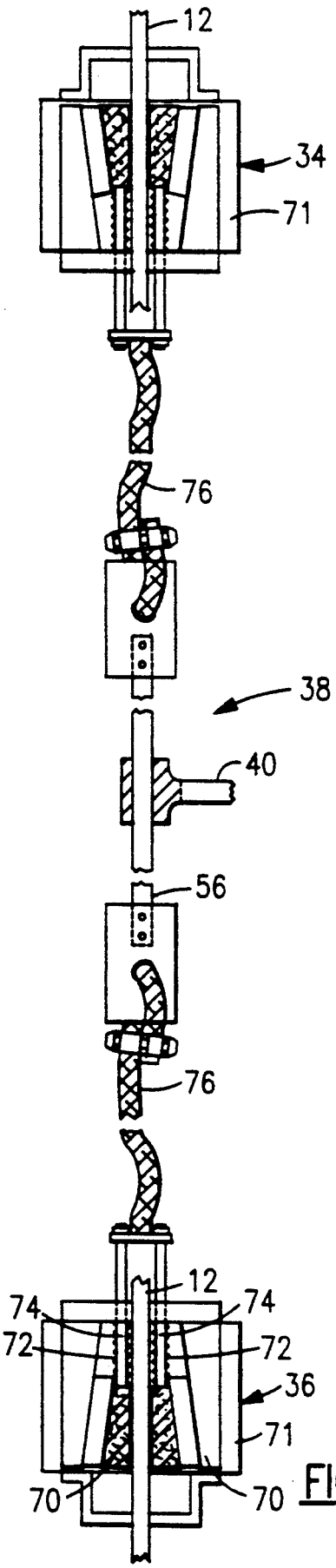
FIG. 3 is a diagrammatic view of a second embodiment of the bidirectional first linkage means shown in FIG. 1.

Referring to FIG. 3, a second embodiment of the first linkage 38 comprises a center link 56 and two lengths of rope 76. One length of rope 76 is fixedly attached to the center link and to the upper safety 34 and the other length is fixedly attached to the center link 56 and the lower safety 36. In both embodiments, the safeties and the bidirectional first linkage 38 are attached to the elevator cab 10.

Referring to FIG. 1, the second linkage 40 comprises a safety crank 49, a center link 51, and a rope crank 81. The safety crank 49 has a first arm 82 and a second arm 83 rigidly attached to each other at an angle. The first arm 82 is pivotly attached to the center link 51 and the second arm 83 is attached to the bidirectional first linkage 38. The crank 49 is pivotly attached to the car 10 by a pin 84 such that the crank arms 82,83 may pivot about the pin 84. The rope crank 81 has a first arm 85 and a second arm 86 rigidly attached to one another at an angle. The first arm 85 of the rope crank 81 is fixed to the rope 18 and the second arm 86 is pivotly attached to the other end of the center link 51. The rope crank 81 is pivotly attached to the car 10 by a pin 90.

Referring to FIGS. 2 and 3, the upper 34 and lower safeties 36 are wedge-type safeties which act on the guiderail 12 of the elevator. The housing 71 of each safety 34,36 has a wedge 70, on each side of the guiderail 12, biased down a cam surface 72 by a spring 74. In multiple guiderail elevators, typically there is a lower 36 and an upper 34 safety cooperating with each rail 12. A person of ordinary skill in the art will recognize that a number of different safeties are known in the art and may be used alternatively.

In the operation of an elevator system having an elevator car 10 within a hoistway (not shown), an elevator car may ascend or descend faster than desired, which may be described as an overspeed condition. In the event of an overspeed condition, pivotally mounted weights 42 comprised within the centrifugal actuator 22 extend radially outward and trip an overspeed switch 44. This may be accomplished using a plunger apparatus as disclosed in Mastroberte, or by any other means known in the art. The switch 44 shown in FIG. 1 has a lever 53 aligned in the same plane as the weights 42 of the centrifugal actuator 22. The lever 53 is positioned radially closer to the weights 42 than either tripper 28,30, and is therefore struck first. In other words, the lever 53 is struck at a lower speed than would be necessary to strike the lugs 45 of the trippers 28,30. The switch 44 may be connected to the motor control circuit in any manner known in the art, so as to exercise a corrective action on the speed control circuits of the motor (not shown) thereby tending to reduce its speed. If this corrective action is sufficient, the speed of the motor, car 10, and sheave will decrease, the weights will move radially inward, and the switch will return to its former position.

If the overspeed condition continues and increases despite the action taken by the overspeed switch 44, the weights 42 of the centrifugal actuator 22 will extend out further and strike the lugs 45 of the first and second trippers 28,30, causing the lugs 45 to rotate. When the lugs 45 rotate, the latches biased against the swinging jaws 48 will pivot and enable the jaws 48 to contact the governor rope 18. Only one of the clutch means 28,30, however, will apply a significant braking force to the governor rope 18 and the elevator car's direction of travel determines which one.

The clutch means 28,30 on the side of sheave 14 where the rope 18 is exiting the sheave 14, will apply a braking force to the governor rope. When the section of rope 18 contacting the swinging jaw 48 is moving downwardly, friction between the rope 18 and the jaw 48 assists gravity in the downward movement of the jaw 48. The swinging jaw 48 comes to rest with links 27,25 substantially horizontal, thereby clamping the rope 18 between the jaws 46,48 with a force dependent upon the force of the spring 50. The opposite swinging jaw 48, in contrast, is prevented from traveling downwardly by the rope which is traveling in the opposite direction.

In sum, a first clutch means 24 will act upon the rope 18 when the elevator is in an overspeed condition in the descending direction 54 and a second clutch means 26 will act on the rope 18 when the elevator is in an overspeed condition in the ascending direction 52. A person of ordinary skill in the art will recognize that the stationary 46 and swinging 48 jaw arrangements as described heretofore and illustrated in FIG. 1 are one embodiment of the clutch means 24,26 claimed which operates to grip the governor rope 18.

Figure 4:
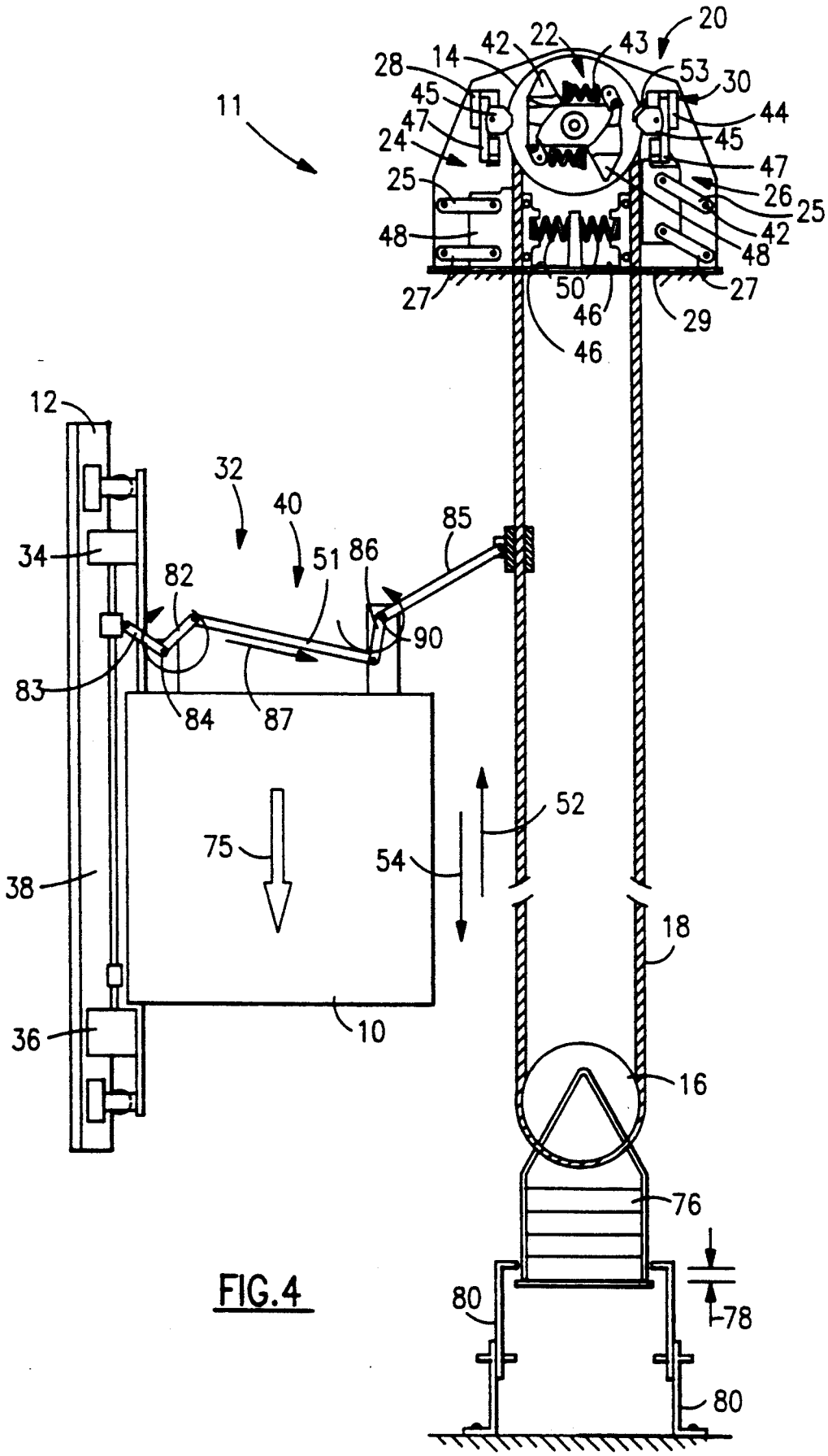
FIG. 4 is a diagrammatic view of FIG. 1 showing the bidirectional linkage actuated in a descending overspeed condition.

Referring to FIG. 4, because the bidirectional governor 20 is stationary relative to the elevator car 10, applying a brake force to the governor rope 18 causes the bidirectional linkage means 32 to move relative to the elevator car. By way of an example, if the car 10 is overspeeding in descent 75 and the rope 18 is gripped, the car 10 will move downward relative to the governor rope 18. More specifically, the car 10 will move downward, relative to the rope 18 causing the rope crank 81 to rotate above the pin 90. As a result, the center link 51 is forced to travel in a direction 87 away from the first linkage 38. Movement of the center link 51 away from the first linkage 38 causes the safety crank 49 to pivot about the pin 84 in a clockwise direction, thereby pulling the bidirectional first linkage 38 upward.

Figure 4A:
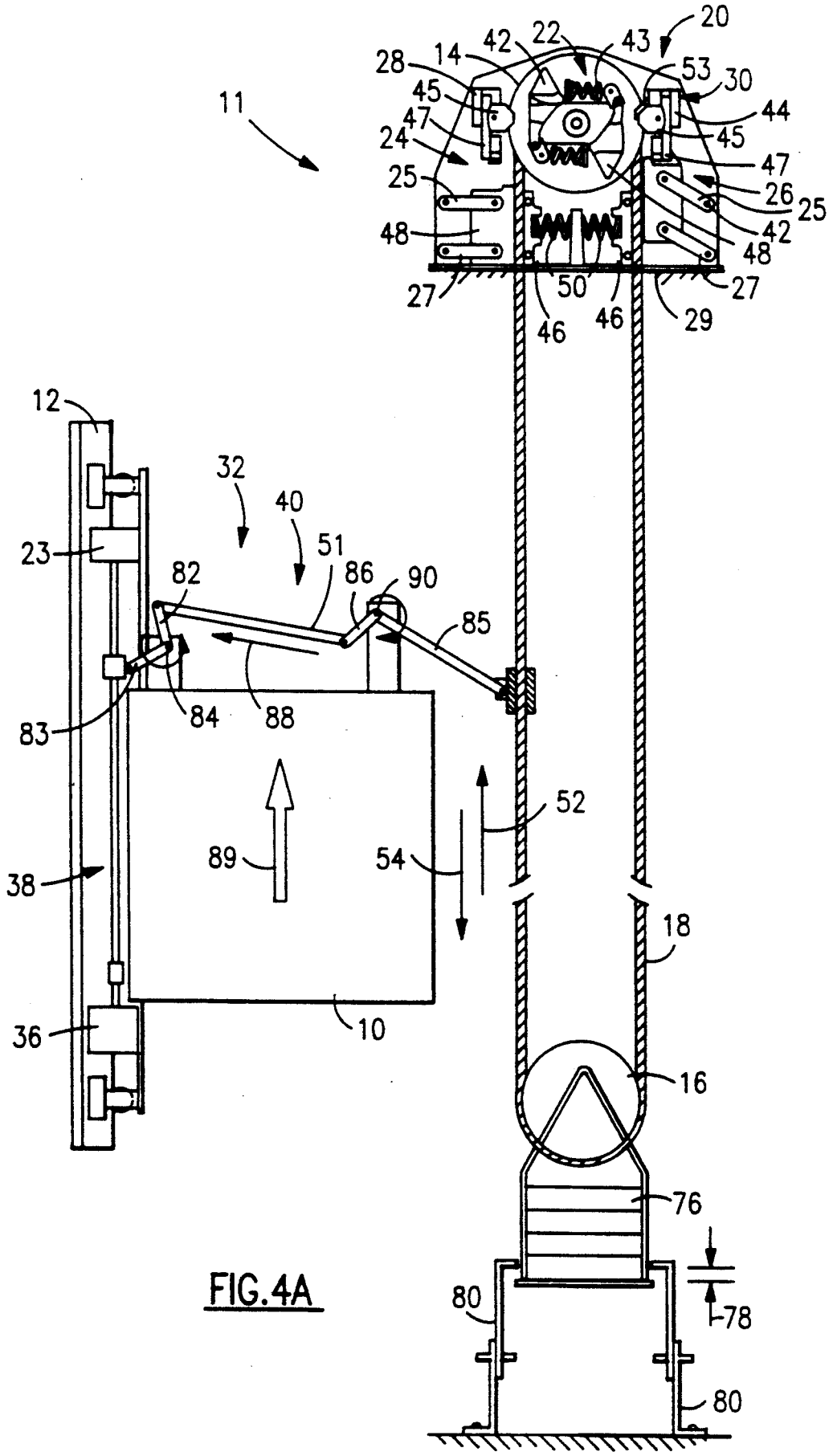
FIG. 4A is the same view as FIG. 4, except the bidirectional linkage is actuated in an ascending overspeed condition.

Referring to FIG. 4A, if, on the other hand, the car is overspeeding in the ascent direction 89, the car 10 would move upward relative to the governor rope 18. More specifically, the car 10 would move upward relative to the rope, causing the rope crank to rotate about the pin 90. As a result, the center link 51 would be forced to travel in a direction 88 toward the first linkage 38. Consequently, the safety crank 49 would pivot in the counterclockwise direction and pull the bidirectional linkage 38 downward.

Referring to FIG. 4, pulling the first linkage 38 upward causes the lower safety 36 to be actuated, thereby safely stopping the car 10. The bidirectional first linkage 38 does not, however, operate the upper safety 34 during an overspeed condition in this direction. By only operating the lower safety 36 (or lower safeties in a multiple rail elevator), and not the upper safety 34, a unidirectional safety may be used without damage.

Referring to FIG. 4A, if the elevator car 10 is overspeeding in the opposite direction, i.e. ascending 52, the first linkage 38 is pulled downward, thereby operating the upper safety 34. Here again, only one of the safeties, the upper 34, is operated because of the bidirectional first linkage.

Referring to FIG. 2, the bidirectional first linkage 38 comprises means for actuating only the upper 34 or the lower 36 safety at a time. In a first embodiment, the first linkage 38 includes a center rod 56, two end rods 58 and two links 60. A link 60 connects each end rod 58 to the center rod 56 and the center rod 56 is, in turn, attached to the second linkage 40. Each end rod 58 is fixed to the link 60 by, for example, a nut 62 on both the outside 64 and inside 66 of the link 60. The center rod 56, in contrast, is slidably fixed to the links 60 with only a single nut 62, thereby allowing the center rod 56 to travel inside the link 60. A person of ordinary skill in the art will recognize that the attachment of the rods 56,58 to the links 60 may be accomplished in a variety of ways.

In the example given, when the second linkage 40 pivots the safety crank 49 (not shown) clockwise (i.e. a descending overspeed condition), the center rod 56 is pulled upward. The nut 62 attached to the center rod 56 on the inside 66 of the lower link 61 will force the lower link 61 and the lower end rod 59 to be drawn upward relative to the elevator car 10. As a result, the lower safety 36 is operated. The other end of the center rod 56 slides into the upper link 63 and the upper safety 34 is not operated. Alternatively, if the second linkage 40 pivots the safety crank 49 (not shown) counterclockwise, (i.e. a ascending overspeed condition), the center rod 56 would pull the upper end rod 55 downward and the upper safety 34 would be operated. The opposite end of the center rod 56 would slide into the lower link 61 and the lower safety 36 would not be operated.

The safety 34,36 operated by the first linkage 38 is a wedge type safety wherein the end rod 58 is attached to a pair of wedges 70. When the end rod 58 is pulled, the wedges 70, normally biased down a pair of cam surfaces 72 by springs 74, are drawn up the cam surfaces 72 and into contact with the guiderail 12, thereby stopping the elevator car 10.

Now referring to FIG. 3, the bidirectional first linkage 38 may alternatively include a center rod 56, and two lengths of rope 76. As in the first embodiment, the center rod 56 is attached to the second linkage 40. In the second embodiment, however, a piece of rope connects the safety 34,36 and the center rod 56 on each side, instead of an end rod 58 and link 60. When the second linkage 40 pulls the center rod 56 either up or down, one rope 76 will be drawn taut and will operate the associated safety 34,36. The other rope 76 will fold or bend on to itself and the associated safety 36, 34 will not be operated.

A person of skill in the art will recognize that the heretofore described arrangement of a lower and an upper safety operating against a rail is typically repeated in an elevator guided by two rails. In the case of redundant arrangements, i.e. one on each rail, both arrangements are operated in the same manner. For example, in the event of an overspeed condition in the descending direction, the lower safety of each arrangement would be operated. Neither upper safety would be operated.

Referring to FIG. 1, the governor rope 18 is tensioned by a series of weights 76 attached to the tension sheave 16. When the second linkage 40 is pulled downward and the upper safety 34 operated, the pull of the second linkage 40 on the governor rope 18 will tend to lift the tension sheave 16 upward. A pair of restraining brackets 80 prevent the tension sheave 16 and the weights 76 from being drawn up the hoistway. The restraining brackets 80 may be adjusted to allow the weights 76 and tension sheave 16 to travel a predetermined amount 78 before being stopped.

Although this invention has been shown and described with respect to the detailed embodiments thereof, it will be understood by those skilled in the art that various changes in form and detail thereof may be made without departing from the spirit and scope of the claimed invention.

We claim:

1. A bidirectional overspeed device for an elevator system, having an elevator car for travel in a hoistway along a guiderail, and a governor rope passing over a governor sheave at the top of the hoistway and a tension sheave at the bottom of the hoistway comprising:
- a bidirectional governor, attached to the governor sheave;
- a first safety brake;
- a second safety brake; and
- a bidirectional linkage means, connecting said safety brakes and the governor rope, wherein an overspeed condition will cause said bidirectional governor to clutch the governor rope, thereby implementing said bidirectional linkage means which in turn operates one of said first and second safety brakes.

2. A bidirectional overspeed device for an elevator system according to claim 1, wherein said bidirectional governor comprises:
- a centrifugal actuator;
- a first clutch means, for clutching the governor rope exiting the governor sheave when the elevator car is descending within the hoistway;
- a second clutch means, for clutching the governor rope exiting the governor sheave when the elevator car is ascending within the hoistway;
- a first tripper; and
- a second tripper, wherein both said trippers prevent said first and second clutch means from clutching the governor rope until an overspeed condition exists, in which case said centrifugal actuator operates said trippers allowing said first clutch means to clutch the governor rope if the elevator car is going upward within the hoistway, and allowing said second clutch means to clutch the governor rope if the elevator car is going downward within the hoistway.

3. A bidirectional overspeed device for an elevator system according to claim 2, wherein said first and second clutch means further comprise:
- a spring mounted stationary jaw; and
- a swinging jaw, wherein an overspeed condition the swinging jaw of one of said first and second clutch means is drawn toward said stationary jaw, thereby clutching the governor rope.

4. A bidirectional overspeed device for an elevator system according to claim 1, wherein said bidirectional linkage means further comprises:
- a bidirectional first linkage, connecting said first and second safety brakes; and
- a second linkage, attached to said bidirectional first linkage and the governor rope, wherein when said bidirectional governor clutches the governor rope, the rope operates said second linkage and said bidirectional first linkage, which in turn operates one of said first and second safety brakes.

5. A bidirectional overspeed device for an elevator system according to claim 4, wherein said bidirectional first linkage further comprises:
- an upper rod end;
- an upper link, fixedly attached to said upper rod end and said first safety;
- a lower rod end;
- a lower link, fixedly attached to said lower rod end and said second safety; and
- a center rod, having a boss at each end, slidably attached to both said upper and lower links and fixedly attached to said second linkage.

6. A bidirectional overspeed device for an elevator system according to claim 4, wherein said bidirectional first linkage further comprises:
- a center rod, fixedly attached to said second linkage; and
- a pair of rope lengths, each length having two ends, wherein one end of each rope is attached to said center link and the other to one of said safeties.

7. A bidirectional overspeed device for an elevator system according to claim 1, further comprising:
- a plurality of restraining brackets, fixed to the hoistway which limit the travel of the tension sheave at the bottom of the hoistway.

8. A bidirectional overspeed device for an elevator system, having an elevator car for travel in a hoistway along a guiderail, and a governor rope fixed to the car, and therefore stationary relative to the car, passing over a governor sheave at the top of the hoistway and a tension sheave at the bottom of the hoistway comprising:
- a bidirectional governor, attached to the governor sheave;
- a first safety brake;
- a second safety brake; and
- a bidirectional linkage means, connecting said safety brakes and the governor rope, wherein a change in the stationary relationship of the governor rope relative to the car in either direction will implement said bidirectional linkage means which in turn operates one of said first and second safety brakes.

* * * * *